United States Patent [19]

Mansfield et al.

[11] 3,969,088

[45] July 13, 1976

[54] FORMCOKE PROCESS

[75] Inventors: Vaughn Mansfield, Gallatin; Charles M. Whitten, Columbia, both of Tenn.

[73] Assignee: Peabody Coal Company, St. Louis, Mo.

[22] Filed: Apr. 28, 1975

[21] Appl. No.: 572,317

[52] U.S. Cl. ..... 44/10 C; 44/19; 201/24

[51] Int. Cl.[2] ..... C10L 5/00

[58] Field of Search ..... 44/10 C, 10 K, 19; 201/6, 24

[56] References Cited

UNITED STATES PATENTS

| | | | |
|---|---|---|---|
| 955,970 | 4/1910 | Korting | 201/24 |
| 1,918,162 | 7/1933 | Willson | 201/24 |
| 3,671,401 | 6/1972 | Gorin | 201/6 X |

*Primary Examiner*—Carl F. Dees

[57] ABSTRACT

Raw coal is charred in pre- and post-treatment carbonizers, then pulverized, mixed with pitch, briquetted, re-circulated through the pre- and post-treatment carbonizers with succeeding green coal, cooled, and finally separated from the as yet unbriquetted char.

12 Claims, 1 Drawing Figure

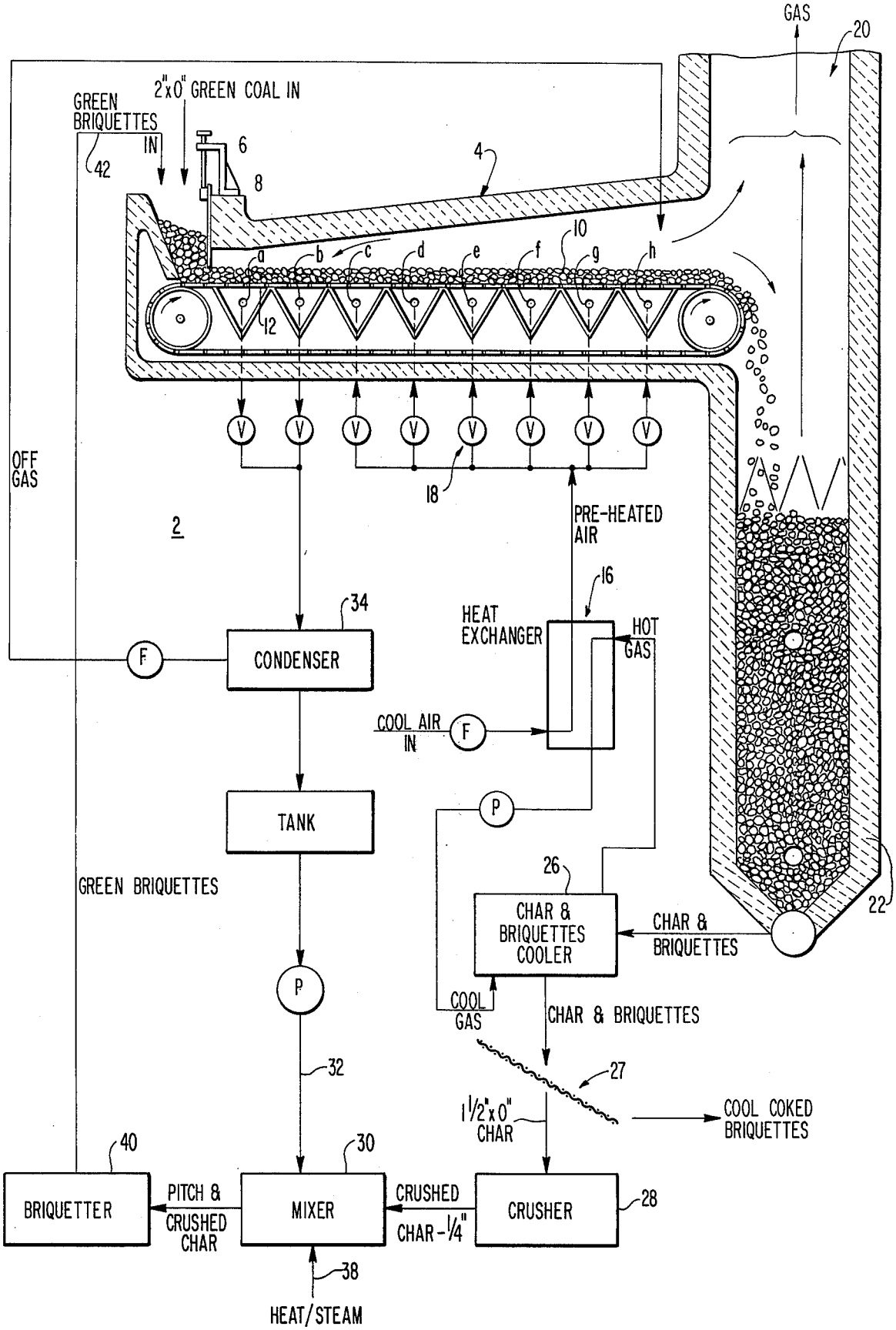
GAS
20
2"x0" GREEN COAL IN
GREEN BRIQUETTES IN
42
6
8
4
10
a
b
c
d
e
f
g
h
12
V
18
OFF GAS
2
PRE-HEATED AIR
16
34
HEAT EXCHANGER
HOT GAS
F
CONDENSER
COOL AIR IN
TANK
P
26
GREEN BRIQUETTES
CHAR & BRIQUETTES COOLER
CHAR & BRIQUETTES
22
COOL GAS
CHAR & BRIQUETTES
32
27
1 1/2"x0" CHAR
COOL COKED BRIQUETTES
40
30
BRIQUETTER
PITCH & CRUSHED CHAR
MIXER
CRUSHED CHAR-1/4"
CRUSHER
28
38
HEAT/STEAM

FORMCOKE PROCESS

FIELD OF INVENTION

Distillation: Processes, Thermoloytic And Shaping To Desired Form and Configuration.

PRIOR ART

Mansfield 3,434,931; Friedrick 3,401,089; Reichl 3,692,505; Gorin et al 3,051,628; Potter, Presidential Address, 1970; Formed Coke, Journal of the Institute of Fuel [497] December, 1970.

OBJECTS

The primary objects are to produce coke briquettes of great strength, suitable for blast furnace and foundry use, at a relatively rapid rate, in a substantially closed system.

More specifically, it is intended to provide a method wherein green coal of widely variant types, i.e., ranging from very low rank brown coal to semi-anthracite can be used as starting material, and wherein the heat of charring of the raw coal is utilized as the primary heat source for curing green briquettes formed of char and pitch, which are re-circulated through a charring system along with the raw coal.

More detailed description of the objects and features of the invention will be given after a resume of the briquetting system in which the invention is carried out, as shown in the diagram which is the sole FIGURE of the drawing. The pre-treatment carbonizer 4 has an input, in this example a hopper 6, into which green coal preferably sized 2 × o inch, with a maximum of about 40% minus ¼ inch, is charged and then spread by a gate 8 to form a bed 10 on the continuously moving chain grate 12. Beneath the chain grate is a zoned airbox 14 having, for example, eight zones *a* to *h* inclusive, the last six of which are supplied with updraft air from a pre-heated air supply 16 in amounts which are carefully controlled and limited by valves 18 to about 1 lb. air per pound of green coal. Exhaust gases from the system are taken off through a stack 20. Stack 20 may supply gases to a boiler (not shown). From the output end of the chain grate, the material being treated falls into a post-treatment carbonizer 22 which, in this instance, is a vertical shaft furnace having a reducing atmosphere, essentially a soaking pit and from which, after a suitable residence time, the material exits to coke cooler 26. At start-up, the exiting material consists of char, but as will be apparent hereinafter, the exiting material, after start-up, consists of char and pre- and post-treated briquettes which together pass from the post-treatment carbonizer 22 to a cooler 26, where the material is cooled to 400° F or less. From cooler 26 the char and briquettes move to a separator 27, for example, a screen, from which the then cool and fully coked briquettes which constitute the end product are taken. The char from which the fully cooked briquettes have been separated moves from the size separator 27 to a crusher 28, where it is sized to minus ¼ inch, and thence to a mixer 30 into which pitch from a pitch supply 32 is fed. In this example, the pitch is derived from a condenser 34. The pitch is obtained by downdrafting some of the initial airbox zones, such as zones *a* and *b* so as to drive off the low-temperature pitch-forming volatiles. The downdrafted fluid is passed through a condenser and the off-gas is forced by a fan F back into the pre-treatment carbonizer at its rear end. The condensed pitch is then stored in a tank and pumped by a pump P to the mixer. Steam from a suitable source 38 is also fed into mixer 32 and the then fully mixed hot pitch and crushed char, then at from about 170° F to 250° E, are fed to a briquetter 40. The water in the steam strengthens the briquettes, both as to green strength and as to carbonized strength. Preferably, the briquetter is of the double-roll type. Green briquettes are fed from briquetter 40 back into the input of pre-treatment carbonizer 4, as indicated at 42. The pre-treatment carbonizer 4 and post-treatment carbonizer 22 which have been diagrammatically illustrated may be similar to the chain grate coking oven and shaft furnaces utilized in the process of the Mansfield patent (supra) and all the other components of the system are conventional elements. Although the chain grate and shaft furnaces which have been diagrammatically illustrated are particularly suited for the subject process, other apparatus may be utilized so long as it satisfies the requirements of the process further detailed below.

At start-up, the pre-treatment carbonizer 4 is preheated by building a fire on chain grate 10. The green coal is spread onto the chain grate and moved through the pre-treatment carbonizer in about twenty minutes time, at the end of which the coal falling off the shaft furnace has been heated to about 2000° F. From the chain grate, the char falls into the post-treatment carbonizer, or shaft furnace 22, where it is retained in a reducing atmosphere at about 1700° F to about 1800° F for about 1 hour. By then the char contains no more than about 5% volatiles by weight. As has been previously described, the char from the post-treatment carbonizer is cooled, crushed, mixed with pitch, heated and briquetted. Thus the infeed to the pre-treatment carbonizer, soon after start-up becomes green coal sized 2 × o inch and green briquettes and consisting of about 83% to 93% by weight of substantially de-volatilized char and about 7% to 15% by weight of pitch. The briquettes must be larger than the pieces of char which emerge from the cooler so that they will not pass through the screen 27 with the char if a screen separator is used. Alternatively, other means may be used for separating the briquettes from the char, in which event the size of the briquettes is not important.

One of the unique features of the process is that the heating rates embodied are extremely high compared with those generally found in the literature. It is well known that briquettes prepared from coal cannot be heated at a rate much in excess of about 32° F per minute without destroying the structure. The rapid evolution of volatile matter burst the briquettes apart. Here, however, the green briquettes rise in temperature from ambient temperature to about 2000° F in about twenty minutes or about 100° F/min.

In this process, as the briquettes pass through the pre-treatment carbonizer 4, some of the low-temperature volatiles in the pitch burn with the undergrate air, and about 50 % of the pitch polymerizes and holds the fixed carbon in the briquettes together in a tight bond. The heat in the pre-treatment carbonizer is generated by the addition of about 1 lb. per air to 1 lb. of combined green briquettes and coal, which air is reacted with the gases released from the green coal and green briquettes. The end-product briquettes are not only virtually de-volatilized, down to no more than about 3% volatile matter, having undergone two complete passes through the pre- and post-treatment carbonizers, but the fixed carbon granules are so tightly held together that the briquettes do not rapidly thermally decompose.

Although the char has not had sufficient residence time in the pre-treatment carbonizer to fully coke, even if the in-feed material is a coking coal, much of the volatile matter in the coal will have been driven off by the time the coal nears or reaches the 2000° F temperature. For example, assuming that the green coal input contained about 40% volatiles, by the time it first passes through the pre-treatment carbonizer, it contains about 12% volatile matter at most.

In addition, the predominance of the volatile remnants in the green briquettes also are driven off in the pre-treatment carbonizer and likewise constitute a heat source for the pre-treatment carbonizer or stack boiler. Also, the same apparatus, i.e., the pre-treatment carbonizer 4 (the chain grate furnace) and the post-treatment carbonizer 22 (the shaft furnace) are simultaneously used for curing the briquettes as are used for producing the char; and the volatiles in the incoming green coal is the heat source for curing the briquettes.

Obtaining the pitch added to the char and mixed in mixer 30 from the pre-treatment carbonizer produces important economic advantages if the cost of the pitch on the open market is high. However, a variety of pitches may be used, including pitch from coal tar and also from petroleum sources. The pitch quantities should be in the range of 7% to 15% by weight. The char, when mixed with pitch and briquetted, produces briquettes with good green strength, i.e., ranging between 200 psi and 400 psi.

Unique advantages accrue from the use of the chain grate stoker furnace as the pre-treatment carbonizer. This being a static bed reactor, the pitch which binds the grains of char in the briquettes together has a chance to polymerize and bind the grains all the tighter before the briquettes are subjected to extensive mechanical agitation. It is believed that about 50% of the pitch polymerizes and becomes a useful part of the end product. All or substantially all the rest is driven off by heat and becomes useful when burned either in the carbonizer or in a stack boiler.

As contrasted with prior art processes wherein green briquettes are exposed to an oxidizing atmosphere, the oxidizing hardening required a treatment of about three hours, whereas oxidizing hardening of the briquettes in this process requires only about twenty minutes, or less, after which they are dumped into the shaft furnace without damage to them.

The process time is relatively short, the maximum time being about one and one-half hours; a minimum of equipment is used, particulate emission is completely controlled (this being a closed system), all known carcinogenic compounds are contained within the process, none being released to the atmosphere; and there are no water polluting or other coal chemicals released to the atmosphere.

Various conventional surge vessels, storage tanks and controls, not shown, are incorporated in the system.

As an alternate procedure, at least some of the green briquettes may be recycled from briquetter 40 directly into the shaft furnace, although in so doing their heat value in the pre-treatment carbonizer would be lost, if stock issued as shown in FIG. 1.

We claim:

1. A process for producing formcoke comprising, charring sized green coal and reducing the volatile content thereof by continuously feeding the same through pre-treatment carbonizer having an oxidizing atmosphere and rapidly increasing the temperature thereof by combustion of primarily volatile matter in the green coal and limited quantities of air, further reducing the volatile content of the char by feeding the same through a post-treatment carbonizer having a reducing atmosphere, passing the char from the carbonizer through a cooler, crushing the cooled char, mixing the crushed char with pitch, forming the mixture of crushed char and pitch into green briquettes, curing and cooling the green briquettes by recycling the same with the sized green coal through at least one of the carbonizers and the cooler, and separating the cooled briquettes from the char.

2. The process claimed in claim 1, characterized in that the green briquettes are recycled with the sized green coal through both carbonizers.

3. The process claimed in claim 1, wherein the pre-treatment carbonizer is a static-bed reactor.

4. The process claimed in claim 3, wherein the static bed reactor is of the horizontal chain-grate type.

5. The process claimed in claim 1, wherein the post-treatment carbonizer is a shaft furnace.

6. The process claimed in claim 1, wherein the pitch mixed with the char is derived by removing from the pre-treatment carbonizer low-temperature volatiles driven from the green coal by the said increasing of the temperature thereof, and condensing the removed low-temperature volatiles.

7. The process claimed in claim 1, wherein the temperature within the atmosphere within the post-treatment carbonizer is maintained at between about 1700° F to 2200° F.

8. The process claimed in claim 7, wherein the residence time of the green coal and green briquettes in the pre-treatment carbonizer is about twenty minutes.

9. The process claimed in claim 8, wherein the temperature of the green coal and green briquettes is raised to about 2000° F in the pre-treatment carbonizer.

10. The process claimed in claim 9, wherein the residence time of the char and briquettes in the post-treatment carbonizer is about 1 hour.

11. The process claimed in claim 1, wherein the pitch has a softening point of from about 120° F to 230° F, and including the step of heating the pitch and crushed char in the mixer.

12. The process claimed in claim 1, wherein the green coal is sized to 2 × 0 inch with no more than about 40% being more than ¼ inch and briquettes are larger in two dimension than the maximum dimension of char emerging from the post-treatment carbonizer.

* * * * *